US010392899B2

(12) United States Patent
Gonzalez et al.

(10) Patent No.: US 10,392,899 B2
(45) Date of Patent: Aug. 27, 2019

(54) INDEXING STIMULATING SLEEVE AND OTHER DOWNHOLE TOOLS

(71) Applicant: Weatherford Technology Holdings, LLC, Houston, TX (US)

(72) Inventors: Dick S. Gonzalez, Spring, TX (US); Cesar G. Garcia, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 595 days.

(21) Appl. No.: 14/934,338

(22) Filed: Nov. 6, 2015

(65) Prior Publication Data

US 2016/0130910 A1 May 12, 2016

Related U.S. Application Data

(60) Provisional application No. 62/077,029, filed on Nov. 7, 2014.

(51) Int. Cl.
*E21B 34/10* (2006.01)
*E21B 23/00* (2006.01)
(Continued)

(52) U.S. Cl.
CPC ..... *E21B 34/10* (2013.01); *E21B 23/006* (2013.01); *E21B 34/14* (2013.01); *E21B 43/14* (2013.01);
(Continued)

(58) Field of Classification Search
CPC ..... E21B 34/10
(Continued)

(56) References Cited

U.S. PATENT DOCUMENTS 6,041,857 A 3/2000 Carmody et al.
6,209,663 B1 4/2001 Hosie
(Continued)

FOREIGN PATENT DOCUMENTS

EP 1260671 A1 11/2002
EP 2484862 A2 8/2012
(Continued)

OTHER PUBLICATIONS

Examination and Search Report in counterpart EP Appl. 15193544.2, dated Dec. 6, 2016, 16-pgs.
(Continued)

*Primary Examiner* — Anna M Momper
*Assistant Examiner* — Patrick F Lambe
(74) *Attorney, Agent, or Firm* — Blank Rome, LLP

(57) ABSTRACT

A downhole tool is responsive to passing objects and applied fluid pressure. A plugless valve in the tool is operable from an unobstructed condition to an obstructed condition unobstructing the tool's bore to an obstructed condition obstructing the tool's bore to the applied fluid pressure. An indexer counts the objects passing through the tool's bore and permits operation of the plugless valve from the unobstructed to the obstructed condition in response to the counted number. The applied fluid pressure in the bore obstructed by the plugless valve can then communicate outside the tool via at least one port. The plugless valve can have a movable insert that moves relative to a flapper. The indexer can use ratcheting dogs, collet, J-slot, electronic sensor, and other components to count the passing objects.

28 Claims, 11 Drawing Sheets

(51) Int. Cl.

| | |
|---|---|
| ***E21B 34/14*** | (2006.01) |
| ***E21B 43/14*** | (2006.01) |
| ***E21B 43/26*** | (2006.01) |
| ***E21B 47/00*** | (2012.01) |
| *E21B 34/00* | (2006.01) |

(52) U.S. Cl.
CPC ..... *E21B 43/26* (2013.01); *E21B 47/00* (2013.01); *E21B 2034/002* (2013.01); *E21B 2034/007* (2013.01)

(58) Field of Classification Search
USPC ..... 166/250.1
See application file for complete search history.

(56) References Cited

U.S. PATENT DOCUMENTS

| | | | | |
|---|---|---|---|---|
| 7,387,165 | B2 | 7/2008 | Lopez de Cardenas et al. | |
| 8,701,776 | B2 | 4/2014 | Smith et al. | |
| 8,978,750 | B2 | 3/2015 | Noske et al. | |
| 2005/0230118 | A1 | 10/2005 | Noske et al. | |
| 2011/0120773 | A1 | 5/2011 | Hilliard | |
| 2011/0192613 | A1 | 8/2011 | Garcia et al. | |
| 2011/0240301 | A1 | 10/2011 | Robison et al. | |
| 2011/0240311 | A1* | 10/2011 | Robison | E21B 23/04 166/373 |
| 2012/0048556 | A1 | 3/2012 | O'Connell et al. | |
| 2013/0168099 | A1 | 7/2013 | Themig | |
| 2013/0186644 | A1* | 7/2013 | Smith | E21B 21/103 166/381 |
| 2013/0299199 | A1 | 11/2013 | Naedler et al. | |
| 2014/0041876 | A1 | 2/2014 | Fleckenstein et al. | |
| 2014/0083689 | A1 | 3/2014 | Streich et al. | |
| 2014/0166292 | A1 | 6/2014 | Crowley et al. | |
| 2014/0166303 | A1 | 6/2014 | Garcia et al. | |
| 2014/0246207 | A1 | 9/2014 | Hoffman | |
| 2014/0262234 | A1 | 9/2014 | Walton et al. | |
| 2014/0262323 | A1 | 9/2014 | Cox et al. | |

FOREIGN PATENT DOCUMENTS

| | | | |
|---|---|---|---|
| GB | 2478995 | A | 9/2011 |
| WO | 99/47789 | A1 | 9/1999 |

OTHER PUBLICATIONS

Patent Examination Report No. 1 in counterpart AU Appl. 2015252150, dated Apr. 1, 2016, 5-pgs.
First Office Action in counterpart CA Appl. 2,911,551, dated Sep. 12, 2016, 6-pgs.
First Examination Report in counterpart GCC Appl. GC 2015-30332, dated Oct. 23, 2018, 3-pgs.

* cited by examiner

INDEXING STIMULATING SLEEVE AND OTHER DOWNHOLE TOOLS

CROSS-REFERENCE TO RELATED APPLICATIONS

This application claims the benefit of U.S. Prov. Appl. 62/077,029, filed 7 Nov. 2014, which is incorporated herein by reference.

BACKGROUND OF THE DISCLOSURE

During hydraulic fracturing operations, operators want to minimize the number of trips they need to run in a well while still being able to optimize the placement of stimulation treatments and the use of rig/fracture equipment. Therefore, operators prefer to use a single-trip, multistage fracing system to selectively stimulate multiple stages, intervals, or zones of a well. Typically, this type of fracturing systems has a series of open hole packers along a tubing string to isolate zones in the well. Interspersed between these packers, the system has fracture sleeves along the tubing string. These sleeves are initially closed, but they can be opened to stimulate the various intervals in the well.

For example, the system is run in the well, and a setting ball is deployed to shift a wellbore isolation valve to positively seal off the tubing string. Operators then sequentially set the packers. Once all the packers are set, the wellbore isolation valve acts as a positive barrier to formation pressure.

Operators rig up fracturing surface equipment and apply pressure to open a pressure sleeve on the end of the tubing string so the first zone is treated. At this point, each fracture sleeve needs to be actuated so fluid can be diverted to flow outwards to fracture the zones of the well. The actuation must be performed in a sequential manner to allow the borehole to be progressively fractured along the length of the bore, without leaking fracture fluid out through previously fractured regions.

Due to the expense and frequent failure of electronic or electrical devices downhole, the most common approach to actuate the sleeve is still fully mechanical. Operators treat successive zones by dropping successively increasing sized balls down the tubing string. Each ball opens a corresponding sleeve so fracture treatment can be accurately applied in each zone.

The sleeves are configured so that the first dropped ball, which has the smallest diameter, passes through the first and intermediate sleeve, which have a ball seat larger than this first ball, until it reaches the furthest away tool in the well. This furthest away sleeve is configured to have a ball seat smaller than the first dropped ball so that the ball seats at the sleeve to block the main passage and cause ports to open and divert the fluid flow.

Subsequently dropped balls are of increasing size so that they too pass through the nearest sleeves but seat at a further away sleeve that that has a suitably sized seat. This is continued until all the sleeves have been actuated in the order of furthest away to nearest. As is typical, the dropped balls engage respective seat sizes in the sleeves and create barriers to the zones below. Applied differential tubing pressure then shifts the sleeve open so that the treatment fluid can stimulate the adjacent zone. Some ball-actuated sleeves can be mechanically shifted back into the closed position. This gives the ability to isolate problematic sections where water influx or other unwanted egress can take place.

Although this still remains the most common technique, this approach has a number of disadvantages. Because the zones are treated in stages, the smallest ball and ball seat are used for the lowermost sleeve, and successively higher sleeves have larger seats for larger balls. Due to this, practical limitations restrict the number of balls that can be run in a single well. Because the balls must be sized to pass through the upper seats and only locate in the desired location, the balls must have enough difference in their sizes to pass through the upper seats. Accordingly, the number of sleeves with varying ball seats that can be used is limited in practice because there must be a significant difference in the size of the seat (and therefore the ball) so that a given ball does not inadvertently actuate a previous sleeve or get pushed through its seat when pressure is applied.

In addition, the seats act as undesirable restrictions to flow through the tubular. The smaller the seat is; then the greater the restriction is. Overall, when stimulating zones through fracturing and then producing, operators want to have a larger bore through as much of the tubing string as possible because it allows for a better production rate. In a typical multistage system of fracturing sleeves, the bore through the tubing string restricts fluid flow due to the different sized restrictions from the various fracturing sleeves. Thus, the system is restricted to a range of internal dimensions for optimum production rate.

To overcome difficulties with using different sized balls, many service companies still use the typical ball and seat approach, but they have sought to optimize the size differences between the different balls and seats. Additionally, multi-stage systems have been developed that utilize one ball size throughout an arrangement of stimulation sleeves.

In other implementations, some operators have used selective darts that use onboard intelligence to determine when the desired seat has been reached as the dart deploys downhole. An example of this is disclosed in U.S. Pat. No. 7,387,165. Moreover, operators have used smart sleeves to control opening of the sleeves. An example of this is disclosed in U.S. Pat. No. 6,041,857. Electronic systems, such as RFID systems, can be used to selectively actuate the sleeves, but these can be complex, expensive, and subject to unique forms of failure. Indeed, forms of electrical, electronic, or magnetic devices may not be robust enough to withstand the harsh downhole environment.

Even though such systems have been effective, operators are continually striving for new and useful ways to selectively open sliding sleeves downhole for fracture operations or the like. The subject matter of the present disclosure is directed to overcoming, or at least reducing the effects of, one or more of the problems set forth above.

SUMMARY OF THE DISCLOSURE

In one embodiment, a downhole tool is responsive to passage of one or more objects and applied fluid pressure. The tool includes a housing, a plugless valve, and an indexer. The housing defines a housing bore therethrough and defines at least one port communicating the housing bore outside the housing. The plugless valve is disposed in the housing and is operable from an unobstructed condition to an obstructed condition. The plugless valve is plugless in the sense that it does not obstruct the housing bore with a deployed plug (e.g., ball, dart, etc.) captured, caught, or held in the valve. Instead, the plugless valve is operable from the unobstructed condition unobstructing the housing bore to the obstructed condition obstructing the housing bore to the applied fluid pressure.

The indexer is disposed relative to the plugless valve. The indexer counts the passage of a number of the one or more objects through the housing bore and permits operation of the plugless valve from the unobstructed condition to the obstructed condition in response to the counted number. The one or more objects can be deployed plugs, balls, darts, or other items. The applied fluid pressure in the housing bore obstructed by the plugless valve in the obstructed condition communicates from the housing bore outside the housing via the at least one port.

In one arrangement, the plugless valve includes a first insert and a valve element. The first insert is disposed in the housing bore and defines a first bore therethrough, which communicates with the housing bore. The valve element is disposed relative to the first insert and is movable from the unobstructed condition unobstructing the first bore to the obstructed condition obstructing the first bore to the applied fluid pressure. In this arrangement, the indexer counts the passage of a number of the one or more objects and permits movement of the valve from the unobstructed condition to the obstructed condition in response to the counted number. In response to the applied fluid pressure against the valve element in the obstructed condition, the first insert is axially movable in the housing bore from a closed condition covering the at least one port to an opened condition exposing the at least one port.

In further particulars of the arrangement, the indexer includes a second insert disposed in the first bore of the first insert and axially movable in the first bore from a first condition toward the valve element in the unobstructed condition to a second condition away from the valve. The second insert in the second condition permits the movement of the valve element from the unobstructed condition to the obstructed condition. For instance, the valve element may be a flapper valve pivotably connected to the first insert and pivotable from the unobstructed condition unobstructing the first bore to the obstructed condition obstructing the first bore. In this way, the valve element in the unobstructed condition obstructs the applied pressure communicated in the first bore of the first insert and permits axial movement of the first insert in the housing bore from the closed condition to the opened condition in response thereto.

To count the passage of the one or more objects, the indexer can include at least one key disposed in a second bore of the second insert. The at least one key is alternatingly engageable and disengagable with the passage of each object in the second bore and is correspondingly disengageable and engageable with at least one slot in the first bore of the first insert. For example, the at least one key can have first dogs disposed about the second bore and axially displaced from second dogs disposed about the second bore. In another example, the at least one key can be formed from a plurality of fingers on one or more collets.

To count the passage of the one or more objects, the indexer can include at least one lock disposed on the second insert and alternatingly locking with the at least one slot in the first bore of the first insert. For example, the at least one lock can include snap rings disposed about the second insert. At least one of the snap rings can have a shoulder along a first (upper) edge for engaging in the at least one slot and can have a ramp along a second (lower) edge for passing out of the at least one slot. The indexer can also include a biasing member biasing the second insert axially in the first bore of the first insert toward the first condition.

To count the passage of the one or more objects, the second insert can have a pin that moves in a J-slot on the first bore of the first insert. The J-slot defines a plurality of junctions for counting the passage of the one or more objects. To count with the at least one key of the indexer, the first bore of the first insert defines a first retraction slot permitting retraction of the at least one key after first movement of the second insert in the first bore. Additionally, the first bore of the first insert defines a second retraction slot permitting retraction of the at least one key after second movement of the second insert in the first bore, the second movement being after the first movement and being longer in extent than the first movement.

To count the passage of the one or more object, the indexer can use an electronic sensor sensing the passage of the one or more objects past the electronic sensor. The indexer can also use an actuator in operable communication with the electronic sensor. The actuator is disposed relative to the second insert and axially moves the second insert toward the second condition. For example, the actuator can be selected from the group consisting of a solenoid, a fuse, a heating coil, a cord, a spring, a motor, and a pump.

In one particular embodiment, a downhole tool can be actuatable in response to passage of one or more objects and applied fluid pressure. The tool includes a housing, a first insert, a valve element, a second insert, and an indexer. The first insert is disposed in the housing bore and defines a bore therethrough. The first insert movable from a closed condition covering at least one port in the housing's bore to an opened condition exposing the at least one port in the housing bore. The valve element is disposed on the first insert and is movable from an opened condition unobstructing the first bore to a closed condition obstructing the first bore. The valve in the closed condition transfers the applied fluid pressure against the valve to movement of the first insert.

For its part, the second insert is disposed in the first bore of the first insert and is movable from a first condition against the valve element in the opened condition to a second condition away from the valve element. The second insert in the second condition permitting movement of the valve element from the opened condition to the closed condition. The indexer is operable between the first and second inserts. The indexer counts passage a number of the one or more objects through the second insert and moves the second insert from the first condition toward the second condition.

In one technique, a method is used for actuating a sliding sleeve downhole on a tubing string. Passage of one or more objects is counted through a bore of the sliding sleeve, and a plugless valve is closed in the bore of the sliding sleeve in response to the counted passage. An insert moves in the bore of the sliding sleeve relative to at least one port in the sliding sleeve with the applied pressure against the closed plugless valve.

To count the passage of the one or more objects, the insert can index axially in the sliding sleeve with each passage. This can involve alternatingly engaging and disengaging each passage and shifting the insert axially in response thereto. Reverse axial movement can be prevented on the insert using one or more locks.

To close the plugless valve in the bore of the sliding sleeve in response to the counted passage without catching, holding, engaging, a plug, ball, or the like, the indexed insert is moved away from the plugless valve, which can use a flapper that pivots across the bore. The one or more objects that are counted passing through the bore can each be released to travel further on in the tubing string. Once operations are done, the plugless valve (e.g., the flapper) can be milled out from the bore of the sliding sleeve.

Although the indexer has been described as counting the passage of a number of the one or more objects, another configuration of the indexer is actuatable by a trigger. In this technique, a method is used for actuating a sliding sleeve downhole on a tubing string with passage of one or more objects through a bore of the sliding sleeve and applied fluid pressure in the bore. A trigger is sensed in the bore of the sliding sleeve, and a plugless valve is closed in the bore of the sliding sleeve in response to the sensed trigger. A port in the sliding sleeve is then opened with the applied pressure against the closed plugless valve.

The foregoing summary is not intended to summarize each potential embodiment or every aspect of the present disclosure.

DETAILED DESCRIPTION OF THE DISCLOSURE

Figure 1:
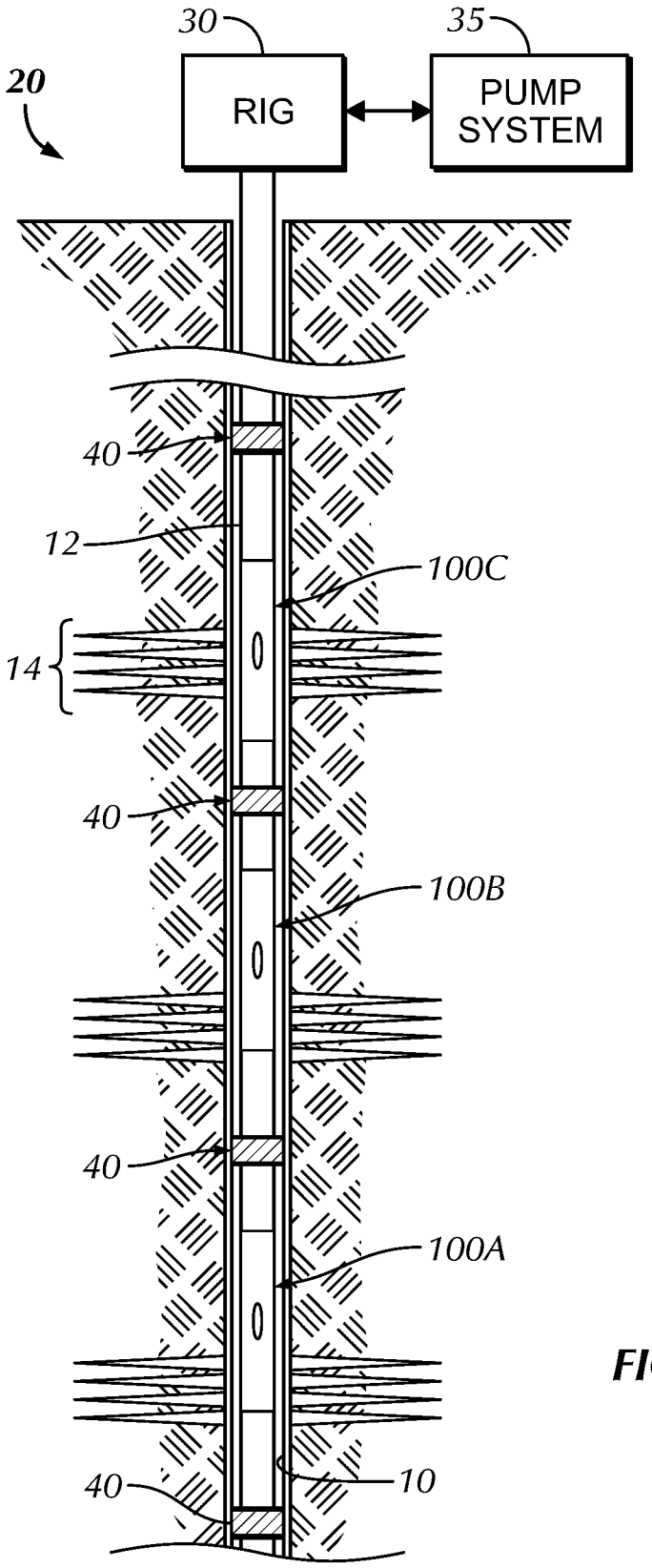
FIG. 1 illustrates a tubing string having indexing sleeves according to the present disclosure.

A tubing string 12 for a wellbore fluid treatment system 20 shown in FIG. 1 deploys in a wellbore 10 from a rig 20 having a pumping system 35. The string 12 has flow tools or indexing sleeves 100A-C disposed along its length. Various packers 40 isolate portions of the wellbore 10 into isolated zones. In general, the wellbore 10 can be an opened or cased hole, and the packers 40 can be any suitable type of packer intended to isolate portions of the wellbore into isolated zones.

The indexing sleeves 100A-C deploy on the tubing string 12 between the packers 40 and can be used to divert treatment fluid selectively to the isolated zones of the surrounding formation. The tubing string 12 can be part of a fracture assembly, for example, having a top liner packer (not shown), a wellbore isolation valve (not shown), and other packers and sleeves (not shown) in addition to those shown. If the wellbore 10 has casing, then the wellbore 10 can have casing perforations 14 at various points.

As conventionally done, operators deploy a setting ball to close the wellbore isolation valve (not shown). Then, operators rig up fracing surface equipment 35 and pump fluid down the wellbore to open a pressure-actuated sleeve (not shown) toward the end of the tubing string 12. This treats a first zone of the formation. Then, in a later stage of the operation, operators selectively actuate the indexing sleeves 100A-C between the packers 40 to treat the isolated zones depicted in FIG. 1.

The indexing sleeves 100A-C have activatable indexers (not shown) according to the present disclosure. Internal components of a given indexing sleeve 100A-C count passage of the dropped plugs or other objects. Once the given indexing sleeve 100A-C has passed a set number of plugs, an internal plugless valve (not shown) in the indexing sleeve 100A-C closes and allows applied fluid pressure to open the given sleeve 100A-C. In this way, one sized plug can be dropped down the tubing string 12 to activate the plugless valve on the indexing sleeve 100A-C so it can be selectively opened.

Although indexing sleeves 100A-C are shown, it will be understood that the system 10 can include other types of sliding sleeves, such as those actuated by engaging a plug with a seat so applied pressure can open the sliding sleeve. In fact, various combinations of conventional sliding sleeves and indexing sleeves 100 can be combined together in a system and can use different sized plugs (i.e., balls) to coordinate different stages of opening the sleeves. In this sense, certain deployed plugs of a smaller size may be allowed to pass through a given one of the indexing sleeve 100 without the passage being counted so that the deployed plug can perform another purpose in the system, such as seating in a conventional sliding sleeve or being counted when passing through another indexing sleeve 100 configured to count the particular deployed plug's passage. It will be appreciated with the benefit of the present disclosure that a number of useful arrangements of different indexing sleeves 100, different deployed plugs, and other downhole tools can be used in a system according to the present disclosure.

With a general understanding of how the indexing sleeves 100 are used, attention now turns to details of indexing sleeves 100 according to the present disclosure.

One embodiment of an indexing sleeve 100 is illustrated during different stages of operation in FIGS. 2-6. The indexing sleeve 100 has a housing 102 defining a housing bore 104 therethrough. One or more external ports 106 on the housing 102 communicate the bore 104 outside the sleeve 100. Ends (not shown) of the housing 102 couple to a tubing string (not shown) in a conventional manner.

Inside, the housing 102 has a main sleeve or insert 110 disposed in its bore 104. The main insert 110, which defines its own bore 112, can move axially from a closed condition (FIGS. 2-5) covering the ports 106 to an open condition (FIG. 6) exposing the ports 106. The main insert 110 can be moved after an appropriate number of plugs (e.g., balls B or other) has passed through the indexing sleeve 100 and applied pressure in the housing 102 moves the insert 110, as discussed in more detail below.

A valve 120 is connected to the main insert 110 and is movable from an opened condition (FIGS. 2-5) unobstructing the housing bore 102 (and insert's bore 112) to a closed condition (FIG. 6) obstructing the bore(s) 102, 112. The valve 120 is plugless in the sense that the valve 120 does not use a deployed plug to seal off fluid flow, as is conventionally done with a typical plug and seat arrangement of the prior art. Instead, the disclosed valve 120 is independent of the deployed plugs and closes to obstruct or block the bores 102, 112 on its own.

An indexer 130 is disposed relative to the main insert 110. As will be discussed below, the indexer 130 counts passage of plugs through the bore(s) 102, 112 and permits movement of the valve 120 from the opened condition (FIGS. 2-5) to the closed condition (FIG. 6) in response to the counted number.

Figure 5:
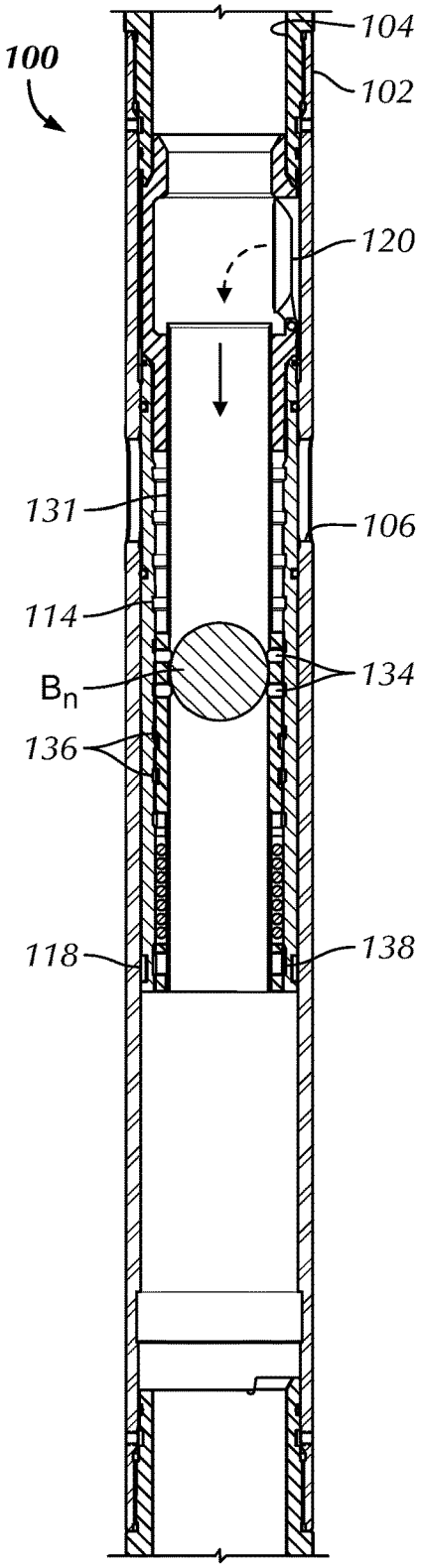
Figure 6:
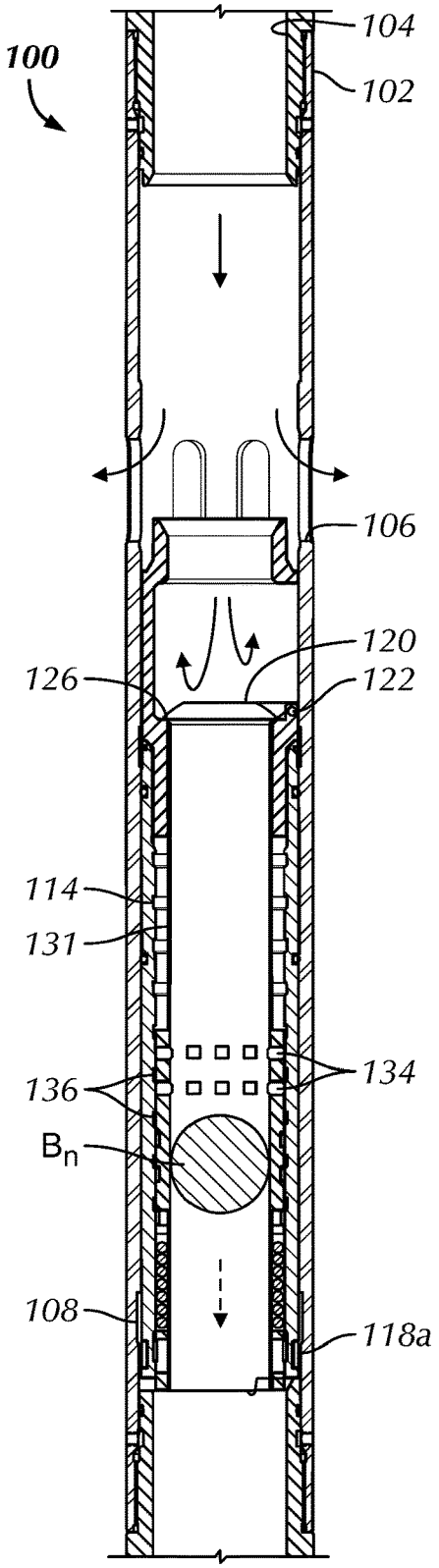

As shown, the indexer 130 includes a second insert or flow tube 131 defining a bore 132. This second insert 131 is disposed in the bore 112 of the main insert 110 and can move axially in the bore 112 from a first condition (FIGS. 2-3) against the valve 120 in the opened condition to a second condition (FIGS. 4-6) away from the valve 120. As shown in FIGS. 5-6, the second insert 130 in the second condition permits movement of the valve 120 from the opened condition to the closed condition to obstruct the bores 102, 112.

In fact, the second insert 131 is a sleeve having a flow tube at its upper end that covers the valve 120, which is a flapper valve pivotably connected by a hinge 122 to a cage 124 on the upper end of the main insert 110. When the second insert 131 is moved axially downward inside the main insert 110, the flow tube at the upper end of the insert 131 exposes the flapper valve 120 to the main insert's bore 112, allowing the flapper valve 120 to pivot across the bore 112 and obstruct flow. The hinge 122 can include a spring or the like to bias the flapper valve 120 to its closed condition (FIG. 6).

Instead of a flow tube at its end, for example, the insert 131 can have a rod, an arm, a linkage, or the like to move away from the flapper valve 120 and allow it to close or to actively grab and close the flapper valve 120.

In operation of the indexing sleeve 100, the indexer's insert 131 indexes as it translates through the main insert 110, which carries the flapper valve 120. Initially, the flapper valve 120 is inaccessible to the flow until the arranged index of the indexer's insert 131 has moved out of the way of the flapper valve 120, which can then close. Once closed, the flapper valve 120 acts as an obstruction in the bore 102, 112 after the last ball B has moved the indexer's insert 131 out of the way.

As can be seen, the plug or ball B is used for indexing the sleeve 100, but the ball B is not seated and used as a plug for opening of the sleeve 100. Instead, the indexing by the ball is disconnected from the plugging of the sleeve 100. Rather, the flapper valve 120 on the main insert 110 acts as the plug mechanism and does not require any external member to create interference in the passage of the fluid.

As noted above, the indexer 130 counts passage of plugs through the bore(s) 102, 112 and permits pivoting of the flapper valve 120 in response to the counted number. To do this, the indexer 130 has keys or dogs 134 disposed in the bore 132 of the second insert 131. The dogs 134 are alternatingly engageable and disengagable with the passage of plugs B in the second bore 132 and are correspondingly disengageable and engageable with slots 114 defined in the first bore 112 of the main insert 110.

Figure 7:
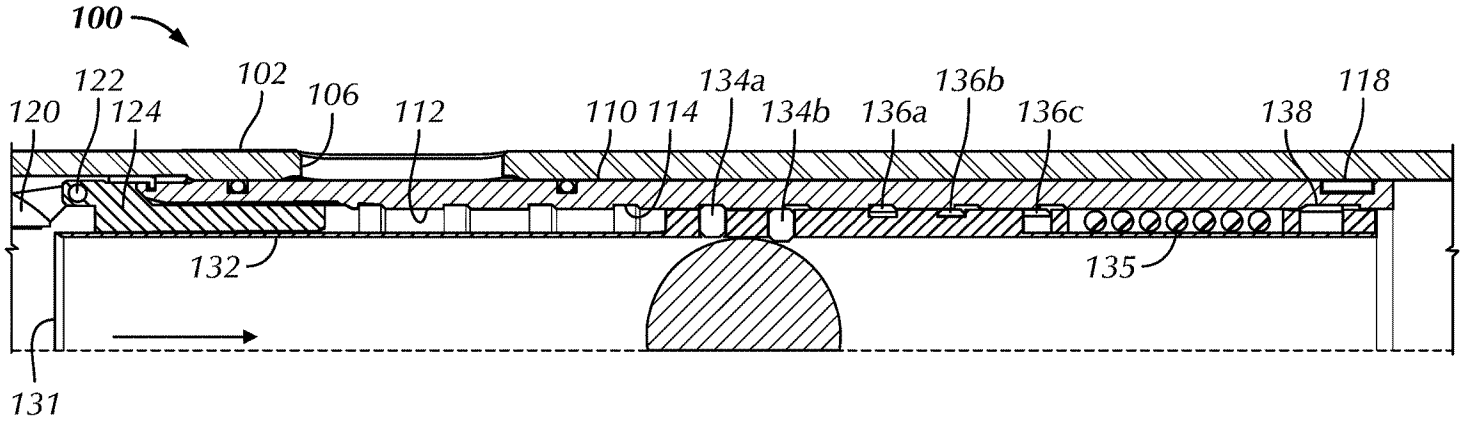
FIG. 7 illustrates a detailed cross-section of a portion of the disclosed indexing sleeve.

For further reference, FIG. 7 shows some particular details of these features. As shown, the dogs 134 specifically include first, upper dogs 134*a* disposed about the second bore 132 and axially displaced from second, lower dogs 134*b* also disposed about the second bore. A passing ball B initially engages the upper dogs 134*a*, which are disposed in between slots 114 and extend into the bore 132. Pressure applied behind the engaged ball B moves the second insert 131 axially in the main insert 110 against the bias of a spring 138. Advancing one indexed step, the upper dogs 134*a* reach a respective slot 114 and retract from the bore 132 and the pushed ball B, while the lower dogs 134*b* leave a respective slot 114 and extend into the bore 132 to engage the ball B.

Again, pressure applied behind the engaged ball B moves the second insert 131 axially in the main insert 110 against the bias of a spring 138. Advancing another indexed step, the lower dogs 134*b* reach a respective slot 114 and retract from the bore 132 to release the ball B to pass further downhole. The upper dogs 134*b* leave a respective slot 114 and extend into the bore 132 to engage any subsequently passed ball B.

To maintain the indexed advancement of the second insert 131, the indexer 130 has a set of locks 136*a-c* disposed on the second insert 131. As the insert 131 advances, the locks 136*a-c* alternatingly engage with the slots 114 in the first bore 112 of the main insert 110. These locks 136*a-c* can be snap rings or the like with ramped lead edges to advance out of the slots 114. At least one of the locks (e.g., 136*c*) has a shoulder on a trailing edge to lock against a respective shoulder of the slots 114 and prevent the bias of the spring 138 from moving the second insert 131 axially back. A body lock ring (not shown) or other ratcheting mechanism could alternatively be used in place of the locks 136*a-c*.

Figure 2:
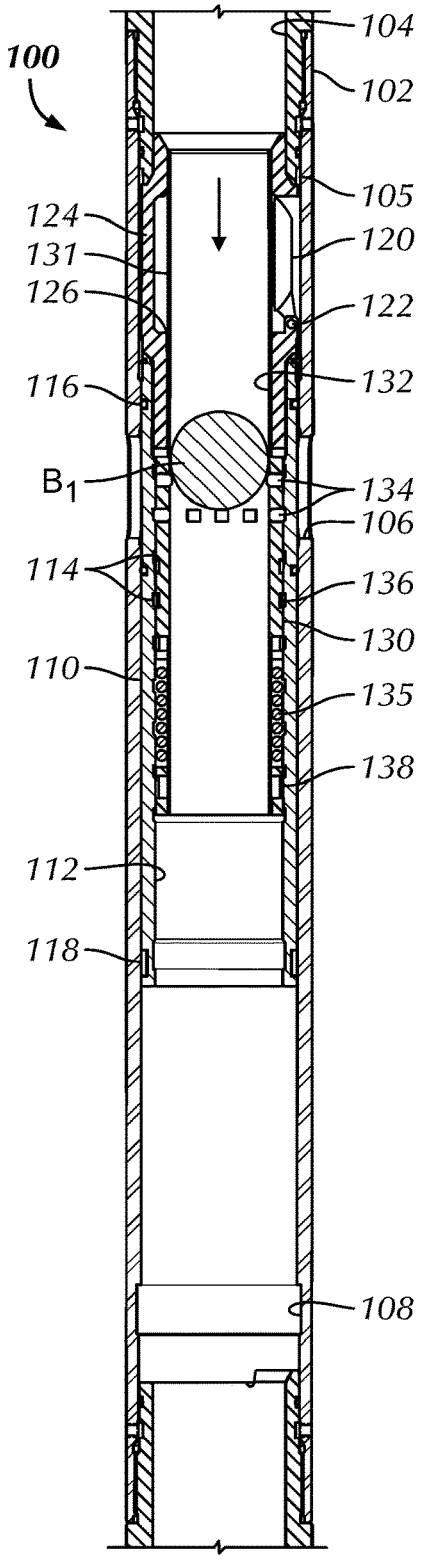
FIGS. 2-6 illustrate cross-sectional views of an indexing sleeve of the present disclosure in different operational states.

Turning now to the activation of the sleeve 100, FIG. 2 shows the sleeve 100 in a closed state having the main insert 110 closed relative to the ports 106. Fluid communicated down the tubing string (not shown) can pass further downhole to other parts of a fracture system, such as other sleeves or the like. During the course of operations, an initial ball $B_1$ is dropped, deployed, pumped, etc. down the tubing string (not shown) to actuate a part of the fracture system. This initial ball $B_1$ reaches the given sleeve 100 as shown in FIG. 2 and engages the upper dogs 134*a* extended into the bore 132 of the indexer 130. Applied pressure behind the ball $B_1$ advances the indexer's insert 131 in the main insert's bore 112.

Figure 3:
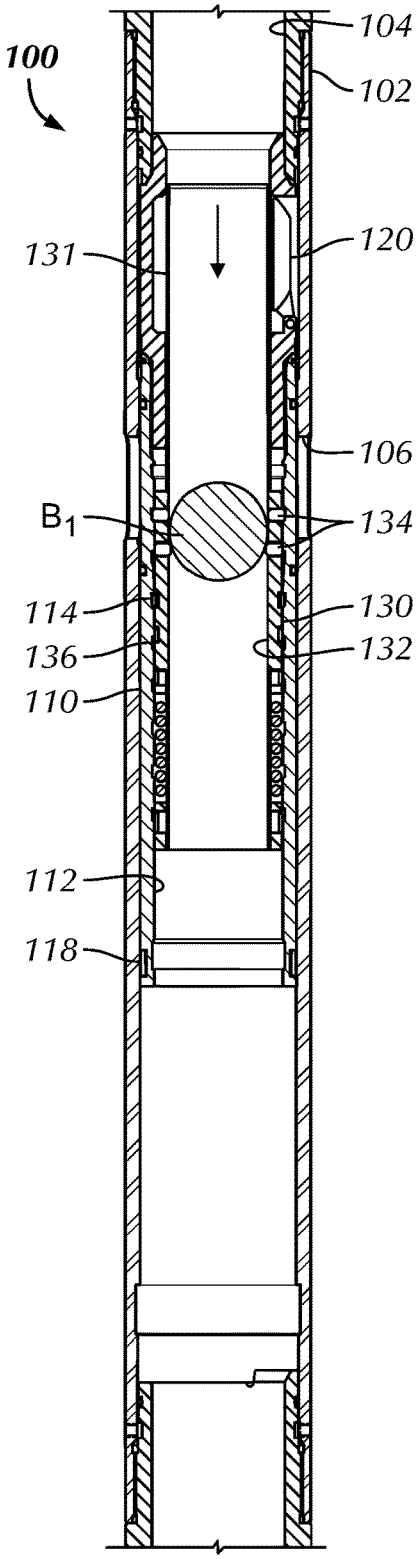

With the advancement as shown in FIG. 3, the upper dogs 134*a* retract from the bore 132, while the lower dogs 134*b* extend into the bore 132 to engage the initial ball $B_1$. Again, applied pressure behind the ball $B_1$ advances the indexer's insert 131 in the main insert's bore 112. With the advancement, the lower dogs 134*a* retract from the bore 132 and allow the initial ball $B_1$ to pass on to other downhole parts of the fracture system. Meanwhile, the upper dogs 134*b* extend back into the bore 132 to engage a subsequent ball (not shown). The locks 136*a-c* on the indexer 130 prevent reverse movement of the indexer's insert 131 so that the flow tube at the end of the insert 131 has moved one indexed movement away from the flapper valve 120.

This process of moving the indexer 130 can then be repeated one or more times by engaging one or more subsequent balls (not shown). The number of balls counted by the indexer 130 depends on the number of slots 114 in the housing 110 and what initial position the indexer 130 had at the start. These can be configured for a particular count depending on the location of the sleeve 100 in the fracture system and the number of balls B it needs to count in the overall scheme of the fracture operations.

Figure 4:
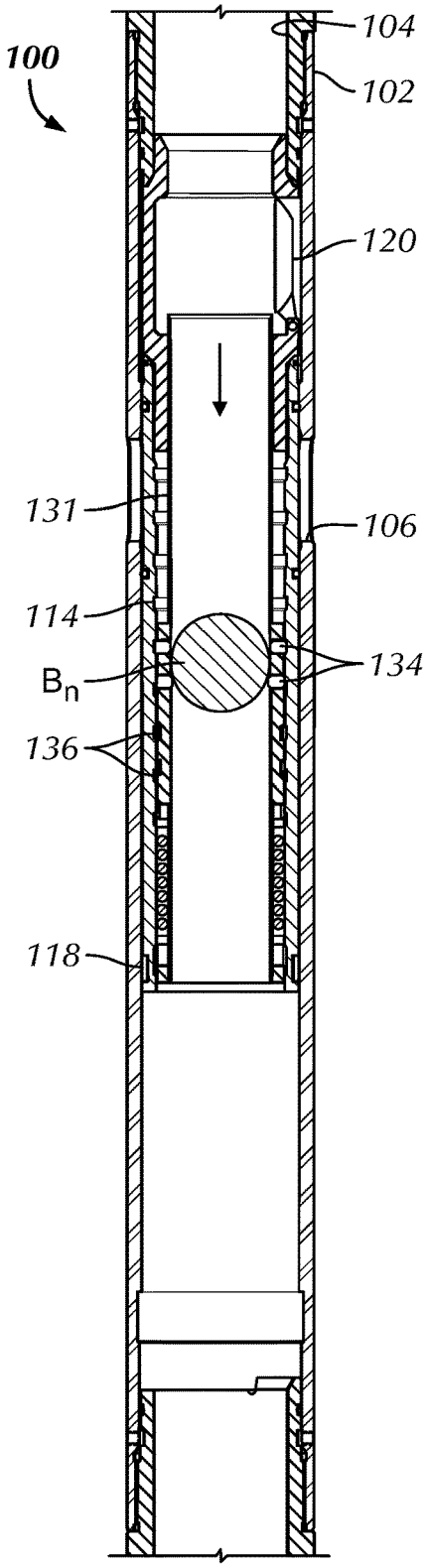

Eventually as shown in FIG. 4, a final ball $B_N$ reaches the indexer 130 and advances the second insert 131 enough to expose the flapper valve 120 to the internal bore 102 of the sleeve 100. At this point, a number of actions are possible to both release and close the flapper valve 120, move the second insert 131 its final movement, and release the ball $B_N$.

As shown in FIG. 5, the final movement of the second insert 131 can move the dogs 134*a-b* out of any slots 114 so that the dogs 134*a-b* extend into the insert's bore 132 and at least temporarily hold the ball $B_N$. This can allow pressure behind the engaged ball B to move the second insert 131 its final movement so that a lock 138 (e.g., snap ring) disposed on the second insert 131 can engage in a groove 118 in the main insert's bore 112. As then shown in FIG. 6, the final ball $B_N$ can be released from the dogs 134*a-b* after being temporarily held. The temporary holding of the ball $B_N$ may not be strictly necessary if the final movement of the second insert 131 for closing the flapper valve 120 can be achieved without the ball $B_N$ being held.

With the insert 131 moved as shown in FIG. 6, the flapper valve 120 can then close off fluid flow further downhole by obstructing the various bores 112, 132. Pivoting of the flapper valve 120 can be achieved primarily by the flow of fluid and applied pressure. A coil spring or the like at the hinge 122 may also assist in pivoting the flapper valve 120. To prevent premature closing of the flapper valve 120, a retainer (not shown) can be used to hold the flapper valve 120 open at least until a necessary flow level, pressure level, movement, or the like is achieved.

With the flapper valve 120 pivoted closed as shown in FIG. 6, the applied pressure forced against the obstructing flapper valve 120 can move the main insert 110 in the housing's bore 104 and eventually expose the ports 106. Notably, the engagement of the flapper valve 120 with the seat area does not need to be a purely fluid tight seal, although it could. Overall, the closing of the flapper valve 120 is intended to create a flow barrier so pressure applied behind the flapper valve 120 can be used to open the main insert 110.

With the main insert 110 moved axially to its open position as shown in FIG. 6, a lock (e.g., snap ring 118*a*) disposed on the main insert 110 can engage in a groove 108 of the housing's bore 104. At this point, the main insert 110 can be held in its open position.

Various faces could be used on the flapper valve 120 depending on the amount of space available. To conserve space and conceal the flapper valve 120 effectively in the housing 102 that is cylindrical, the flapper valve 120 may be curved to fit in the annulus between the flow tube 131 at the end of the insert 130 and the housing's bore 104. Such a conventional curved shape found on downhole, curved flappers can allow the flapper valve 120 of the disclosed sleeve 100 to fit in an annular space between the flow tube of the second insert 131 and the bore 104 of the housing 102. Additionally, the seating area 126 for the flapper valve 120 can have a corresponding shape suited for the curved flapper.

In one configuration, the second insert 131 locks in its final position away from the flapper valve 120 and does not move back to its initial position. Use of the snap rings 136*a-c* for the locks on the second insert 131 can lock the insert 131 in its final position.

Should the lock used between the second insert 131 and the main insert's bore 112 allow for final release, then the second insert 131 can be released and allowed to move to its initial position with the flow tube closing and covering the flapper valve 120 in the cage 124 once fluid pressure against the closed flapper valve 120 recedes. This may allow the flow passage through the sleeve 100 to be reopened after the fracturing of the respective zone. The lock (not shown) used to achieve this may include a body lock ring or other ratcheting mechanism that is sheared free and released once the second insert 131 reaches its final position in the insert's bore 112.

After the multistage fracturing operations are complete, operators may or may not mill out components of the sleeve 100. For instance, the indexing sleeve 100 can still operate with the flapper valve 120 remaining and still allow production flow uphole. Pressure can equalize across the flapper valve 120, allowing it to open during production. Alternatively, operators may mill out internal components of the sleeves 100 to provide a larger internal dimension for production. This is typically done using a milling tool to mill components that restrict the bore through the tubing string.

Accordingly, milling can be used with the disclosed sleeve 100 to remove restrictions. For example, milling can remove components of the flapper valve 120 and the indexer 130. The main insert 110 can remain in the housing 102 after milling and may engage with anti-rotation components inside the housing 102. Milling can also mill out the flapper valve 120, the cage 124, the second insert 131, dogs 134, spring 138, etc.

Various materials can be used for these components to achieve both sealed operation during fracture treatment and subsequent milling. For example, certain components can be composed of cast iron, aluminum, composite, phenolic, or other millable material. Certain components may be composed of a dissolvable material intended to degrade or dissolve over time with downhole exposure. Various options for materials, milling procedures, and the like are available and used with the conventional ball and seat arrangements on sliding sleeves, and the disclosed indexing sleeves 100 can benefit from similar options.

Finally, regardless of whether milling is performed or not, operators may or may not close the various inserts 110 on the sleeves 100 after their use. Closing the inserts 110 can be achieved in a number of ways, including using a shifting tool on appropriate profiles (not shown) on the insert, using coiled tubing to engage the insert 110 and mechanically shift it in the housing 102, etc.

Figure 8:
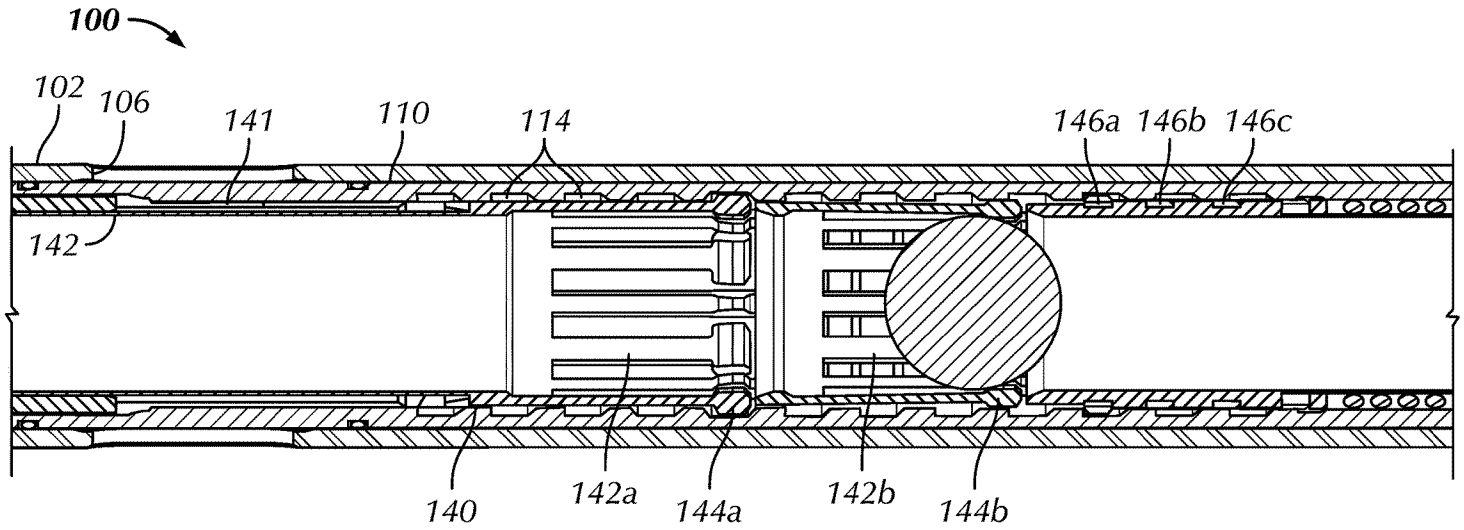
FIG. 8 illustrates a cross-sectional view of a portion of the disclosed indexing sleeve having an alternative indexer.

In previous implementations, the indexer 130 uses dogs 134*a-b* for alternatingly engaging and disengaging in slots in the bore 112 of the main insert 110 to alternatingly retract and extend in the second insert's bore 132. Other configurations can be used for indexing. For example, FIG. 8 shows an indexer 140 for the disclosed sleeve 100. Features of this indexer 140 can be similar to features disclosed in U.S. Pat. No. 8,701,776, which is incorporated herein by reference.

The indexer 140 is similar in many respects to that disclosed previously with reference to FIGS. 2-6. Again, the indexer 140 includes a second insert or flow tube 141, which is axially movable in the bore 112 of the main insert 110 away from the flapper (120). Rather than using dogs as before, the indexer 140 has upper and lower collets 142*a-b*—each having a plurality of keys or fingers 144*a-b*. The fingers 144*a-b* are alternatingly engageable and disengagable with the passage of plugs B in the second bore 142 and are correspondingly disengageable and engageable with slots 114 defined in the first bore 112 of the main insert 110. The indexer 140 also has a similar configuration of locks 146*a-b*.

Figure 9A:
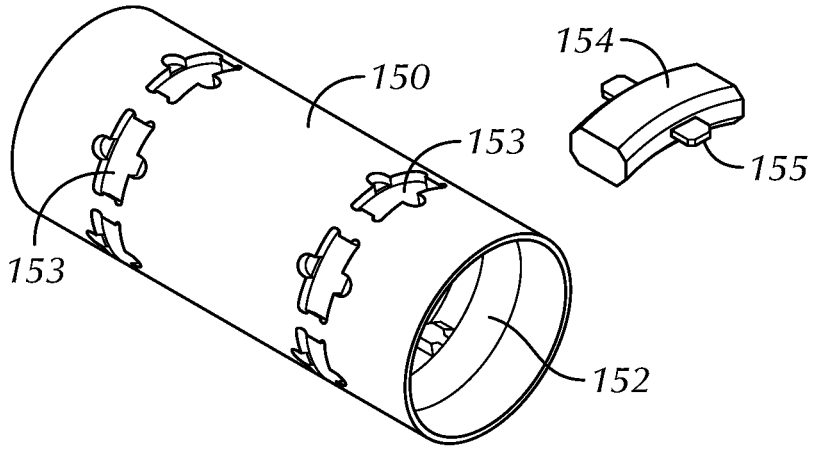
FIGS. 9A-9B illustrate perspective and cross-sectional views of portion of another indexer for the disclosed indexing sleeve.
Figure 9B:
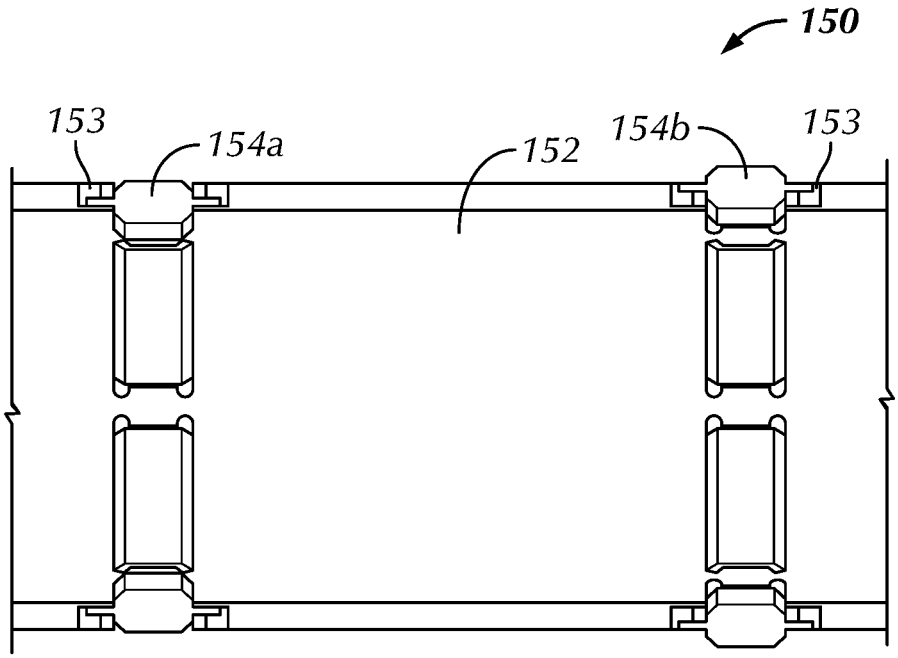

In another example, FIGS. 9A-9B shows portion of another indexer 150 for the disclosed sleeve 100. Features of this indexer 150 can be similar to other features also disclosed in U.S. Pat. No. 8,701,776. The indexer 150 is similar in many respects to that disclosed previously with reference to FIGS. 2-6 and includes a second insert 151. Again, this second insert 151 is axially movable in the bore (112) of the main insert (110) away from the flapper (120).

This indexer 150 uses a dog assembly having two sets of keys or dogs 154*a-b* rather than the fingers of collets. Each set of dogs 154*a-b* are equally spaced around the tubular body of the insert 151. As before, the dogs 154*a-b* are engageable with slots (114) of the insert's bore (112). Each dog 154*a-b* is disposed in a window 153 of the insert 151, and each dog 154*a-b* is movable between a retracted position flush with the insert's bore 152 and an extended position protruding into the bore 152. FIG. 9B shows both positions.

Each dog 154*a-b* can have wings 155 to prevent the dog 154*a-b* from escaping the windows 153.

Other mechanical indexing mechanism can be used. For example, a J-slot indexing mechanism can be used to count passage of deployed plugs or balls B to then close the flapper valve 120 so the sleeve's insert 110 can be opened with applied pressure. Looking at FIGS. 10A-10D, cross-sectional views show the disclosed indexing sleeve 100 having yet another indexer 130 based on a J-slot mechanism. The indexing sleeve 100 has many of the same components as before so that like reference numbers are used for similar components.

Figure 11:
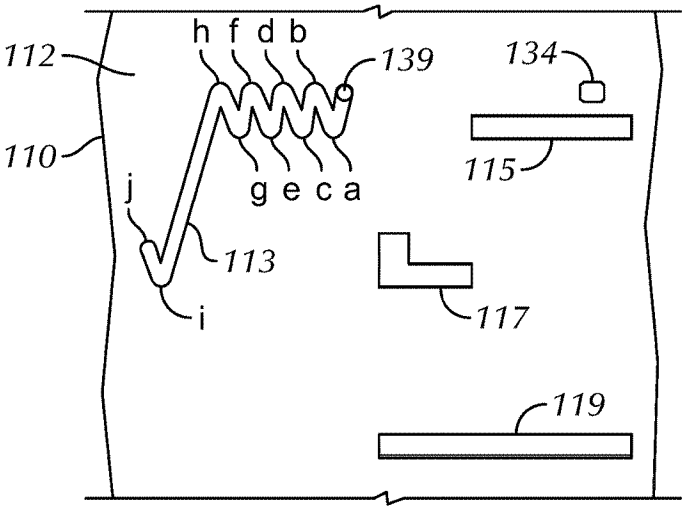
FIG. 11 diagrams details of the indexer of FIGS. 10A-10D.

In some differences, the inner bore 112 of the main insert 110 defines a different arrangement of slots. In particular, FIG. 11 diagrams a portion of the inside surface of the main insert's inner bore 112. For instance, portion (e.g., one quarter or one half) of the circumference of the main insert's inner bore 112 is shown in FIG. 11 as if rolled out flat to reveal the arrangement of slots. This same pattern can repeated symmetrically on the remaining portion of the bore's surface, which is not shown.

As shown in FIG. 11, a J-slot 113 is defined on portion of the bore's surface for indexing movement of the indexer (130). As diagramed, a pin 133 that is disposed on the exterior of the indexer (130) can ride in this J-slot 113 between a number of junctions (a through j). The bore's surface also defines a first retraction slot 115 about portion of its circumference for retraction of the indexer's keys or dogs 134—one of which is shown isolated for illustrative purposes.

A second retraction slot 117 is axially displaced from the first retraction slot 115 and encompasses another portion of the bore's circumference. This second retraction slot 117 is also used to retract the indexer's key 134 after the indexer (130) makes its final index of junction (h) to (i), as discussed below. Finally, a retention slot 119 is defined on the bore's surface for locking the indexer (130), as discussed below.

Figure 10A:
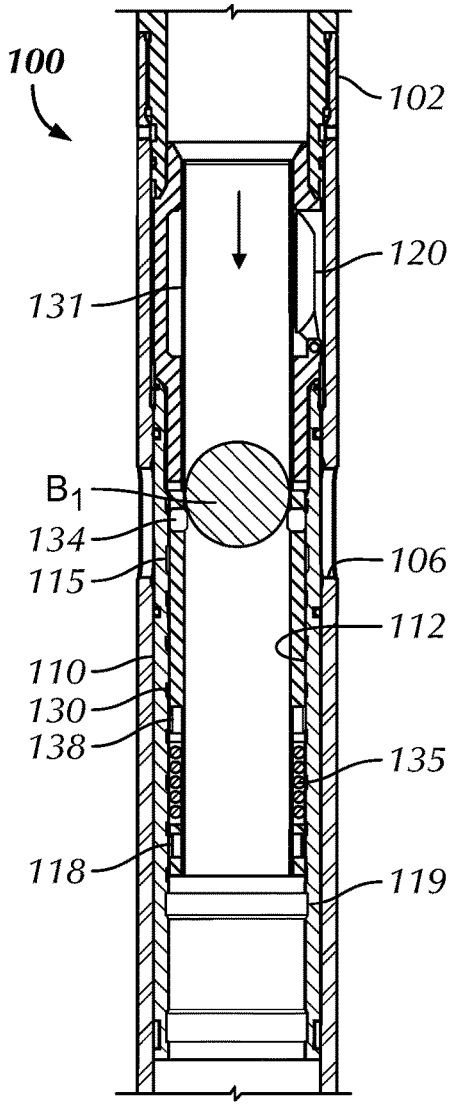
FIGS. 10A-10D illustrate cross-sectional views of the disclosed indexing sleeve having yet another indexer.

With an understanding of the various slots 113, 115, 117, & 119; pins 133; and keys 134; discussion turns to how these components can be used to index passage of balls through the sleeve 100. As shown in FIG. 10A, an initial ball $B_1$ deployed to the sleeve 100 engages the extended keys 134 on the indexer 130. Applied pressure behind the seated ball $B_1$ pushes the indexer's insert 131 down against the bias of the spring 135.

Figure 10B:
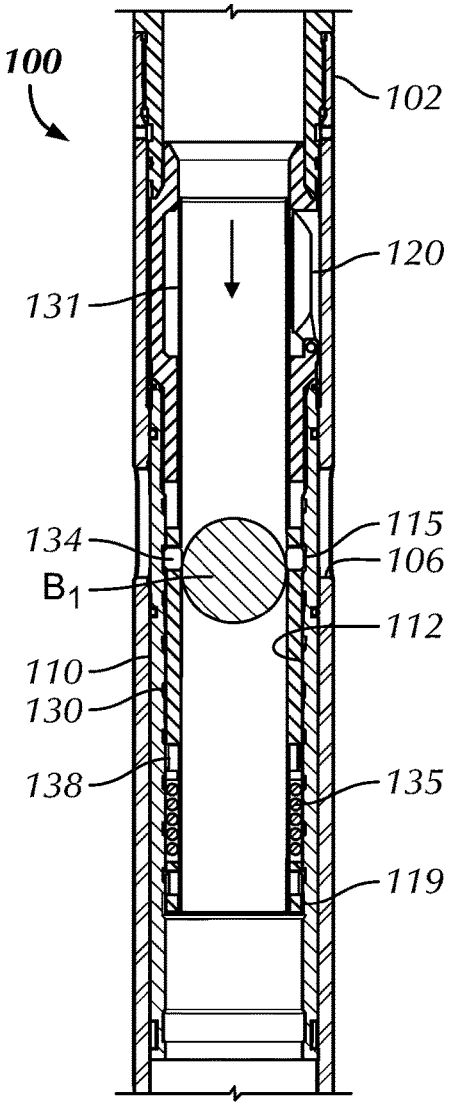

As shown in FIG. 10B, the indexer's insert 131 moves axially down an amount, and the keys 134 reach the first retraction slot 115 allowing for release of the ball $B_1$. As can be seen in FIG. 11, this first movement axially down translates to movement of the pin 133 to junction (a) in the J-slot 113 and to a slight turn of the indexer's insert 131 in the main insert's bore 112. With the ball $B_1$ released as shown in FIG. 10B, the biasing element 135 can then push the indexer's insert 131 upward to its starting position so that the indexer's keys 134 extend outward again in the manner of FIG. 10A to engage the next ball. As can be seen in FIG. 11, this reverse movement axially upward translates to movement of the pin 133 to junction (b) in the J-slot 113 and to a slight turn of the indexer's insert 131 in the main insert's bore 112. This amounts to a count of one passage of the ball $B_1$.

Figure 10C:
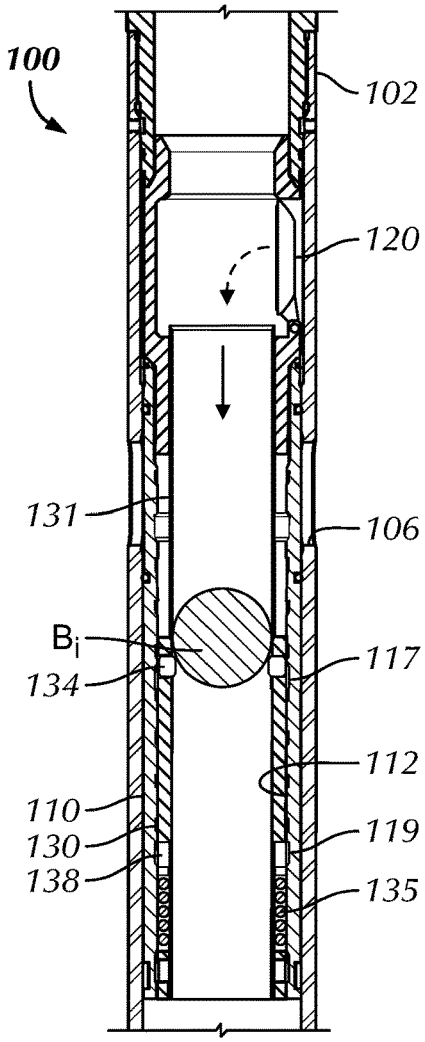
Figure 10D:
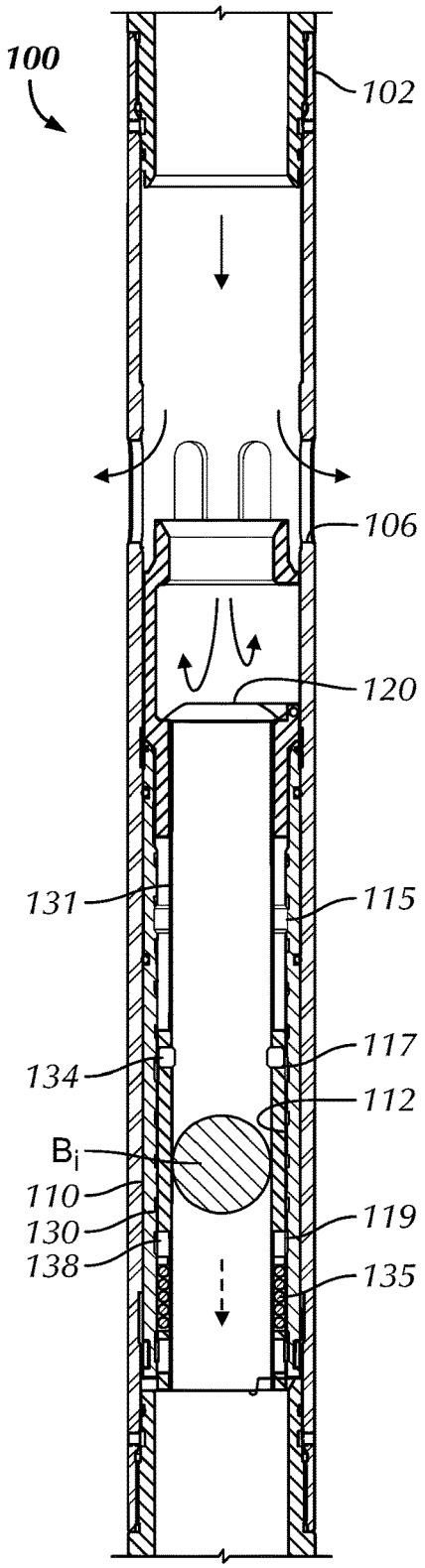

The above indexing process can be repeated as many times as desired, depending on the number of provided junctions. Eventually as shown in FIG. 10C, a final ball $B_i$ is deployed and engages the extended keys 134, when—as shown in FIG. 11—the pin 133 resides in junction (h). Applied pressure behind the seated ball $B_i$ pushes the indexer's insert 131 down against the bias of the spring 135.

Because the indexer's insert 131 has made turns relative to the main insert 110, the keys 134 remain extended as they travel axially along the surface of the bore 112 in the space between the first and second retraction slots 115 and 117. Eventually, the keys 134 reach the second retraction slot 117 allowing for release of the final ball $B_i$.

As can be seen in FIG. 11, this final movement axially down translates to movement of the pin 133 to junction (i) in the J-slot 113 and to a slight turn of the indexer's insert 131 in the main insert's bore 112. With the final ball $B_i$ released, the biasing element 135 then pushes the indexer's insert 131 axially upward, which translates to movement of the pin 133 to the last junction (j) in the J-slot 113.

At the same time of this final movement toward junction (i), the lock ring 138 on the indexer 130 engages at the retention slot 119, as shown in FIG. 10C. This can hold the indexer 130 in its axially downward position in the main insert 110, which allows the flapper valve 120 to pivot down. As eventually shown in FIG. 10D, applied pressure against the closed flapper valve 120 can then be used to push the main insert 110 open relative to the housing's exit ports 106.

Although mechanical indexing in response to passage of deployed plugs or balls B may be preferred in some implementations and has been described above, the disclosed tool, such as the sliding sleeve 100, can also use electronic indexing and can respond to passage of deployed plugs, balls, or even other objects, such as tags, markers, and the like.

Figure 12A:
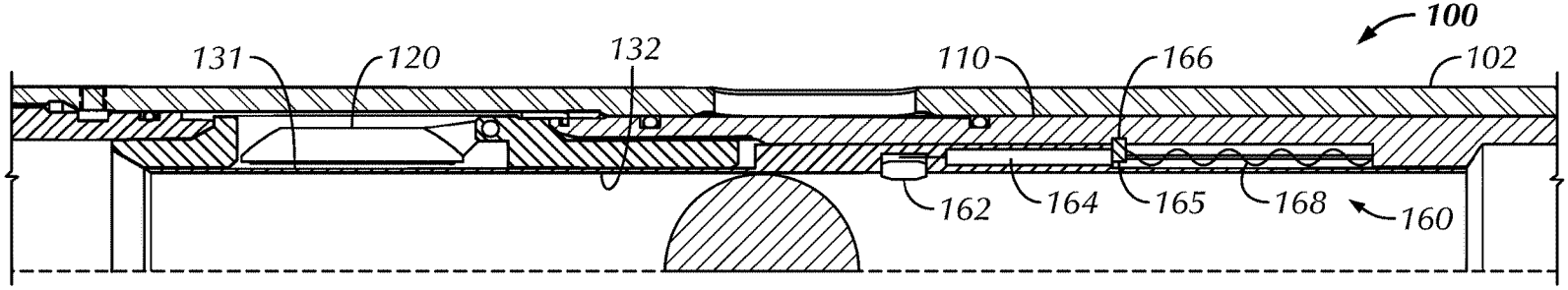
FIGS. 12A-12C illustrate cross-sectional views of portions of the disclosed indexing sleeve with different electronic index devices.

In one particular example, FIG. 12A shows the disclosed sleeve 100 having a housing 102, a main insert 110, a flapper valve 120, and an indexer 130. Rather than mechanically indexing with the passage of a ball B through the sleeve 100, an electro-mechanical index device 160 counts the passage of the balls B. Then, when a set number of balls B pass, the index device 160 moves the indexer 130 so that the flow tube 131 exposes the flapper valve 120, allowing it to close.

A number of electro-mechanical index devices 160 can be used to mechanically engage the passage of the ball, electronically count that passage, and then electronically trigger the mechanical movement of the indexer 130. In this example, the device 160 include a biased button 162 disposed in the bore 132 of the indexer 130. Electronics 164 count when a passing ball B engages and moves the button 162. When a set number of passages occur, the electronics 164 then activate the movement of the indexer 130.

For instance, the electronics 164 can couple to a fuse 165 for a breakable retainer 166. When the fuse 165 is triggered, it breaks the retainer 166, allowing for movement of the indexer 130. In one arrangement, an extended biasing element 168 can then pull the indexer 130, moving the flow tube 131 so the unconcealed flapper valve 120 can close.

Figure 12B:
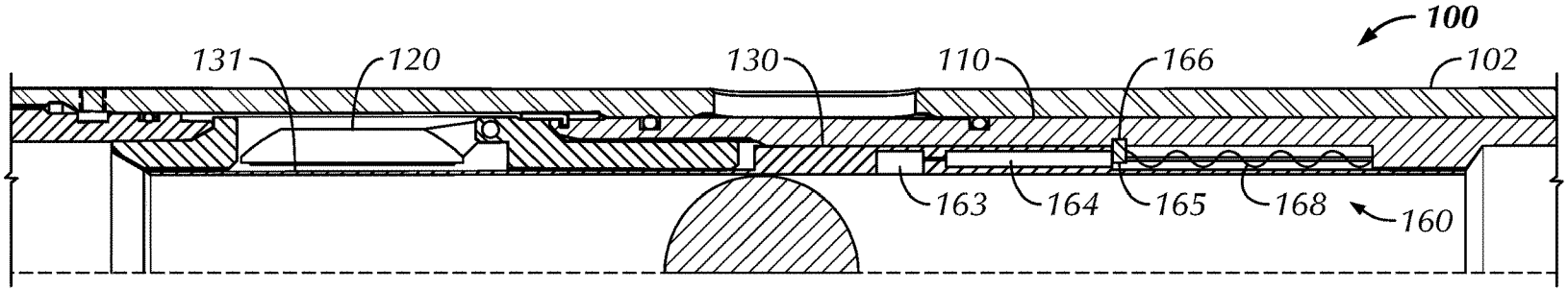

In another example of FIG. 12B, the index device 160 includes an electronic sensor 163 that senses the passage of plugs, balls, or other objects (e.g., RFID tags, magnetic elements, etc.) through the sleeve 100. The electronics 164 count when a passing object passes the sensor 163, and when a set number of passages occur, the electronics 164 then activate the movement of the indexer 130. For instance, the electronics 164 can trigger the fuse 165 to break the retainer 166 so the extended biasing element 168 can move the indexer 130.

Figure 12C:
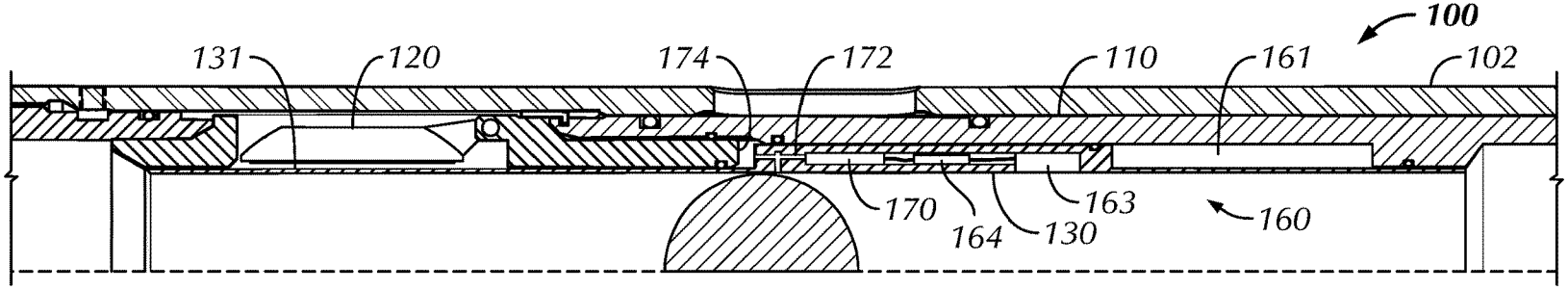

In yet another example of FIG. 12C, the index device 160 includes an electronic sensor 163 that senses the passage of the plugs, balls, or objects through the sleeve 100. Electronics 164 count when a passing ball or other object passes the sensor 163, and when a set number of passages occur, the electronics 164 then activate the movement of the indexer 130. For instance, the electronics 164 can include a solenoid 170 that opens passage of an internal port 172 so tubing pressure can enter a chamber 174 and move the indexer 130 to reveal the flapper valve 120. An opposing vacuum chamber 161 may facilitate the movement.

Figure 13:
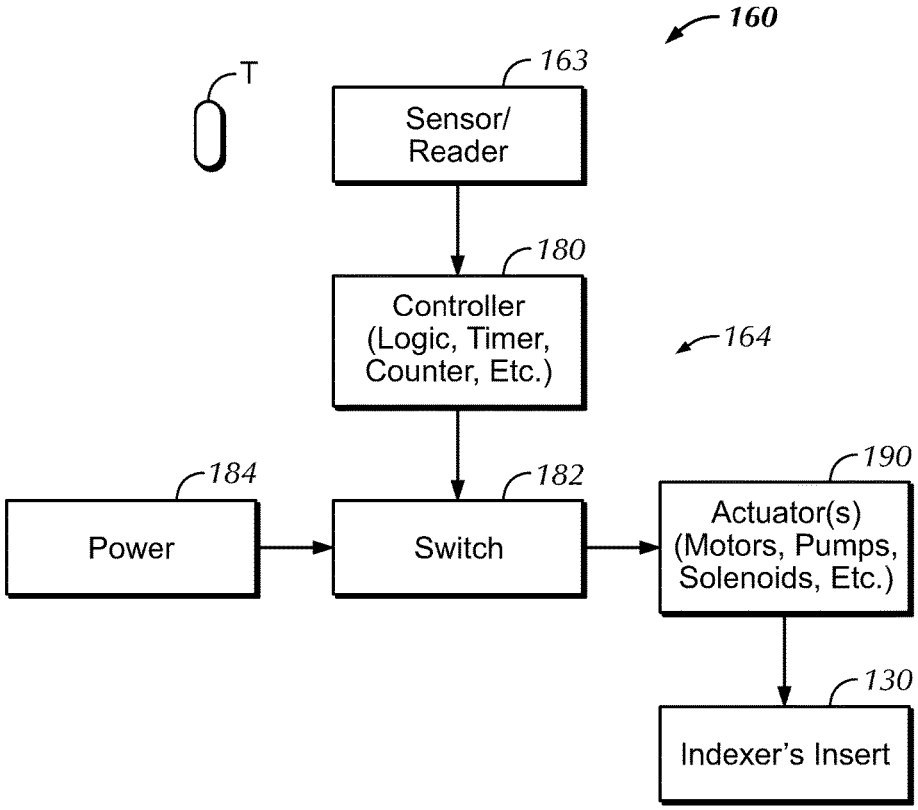
FIG. 13 schematically illustrates components of an electronic index device.

Some possible components of the index device 160 are schematically illustrated in FIG. 13. The electronics 164 include a controller 180, which can include any suitable processor for a downhole tool. The controller 180 is operatively coupled to the sensor or reader 163 and to an actuator 190.

The type of sensor or reader 163 used depends on how commands are conveyed to the index device 160 while deployed downhole. Various types of sensors or readers 163 can be used, including, but not limited to, a radio frequency identification (RFID) reader, sensor, or antenna; a Hall Effect sensor; an electronic button; and the like. For example, to detect passage of the balls B, the sensor 163 can be activated with any number of techniques—e.g., RFID tags or magnetic elements T can be disposed in the balls B or physical passage of the balls B other their own can activate the sensor 163. In other examples, the sensor 163 does not require the passage of a ball B or other such plug and instead may merely sense passage of objects or other triggers T, such as RFID tags, magnetic elements, and the like, passing in the flow stream. Any other form of sensing could also be used as triggers, such as chemical tracers used in the flow stream; mud pressure pulses (if the system is closed chamber); mud pulses (if the system is actively flowing); etc.

For instance, the sensor 163 can be an RFID reader that uses radio waves to receive information (e.g., data and commands) from one or more electronic RFID tags T, which can pass alone in the flow or can be attached to a ball B, plug, or the like. The information is stored electronically, and the RFID tags T can be read at a distance from the reader 163. To convey the information to the apparatus 100 at a given time during operations, the RFID tags T are inserted into the tubing (20) at surface level and are carried downhole in the fluid stream. When the tags T come into proximity to the apparatus 100, the electronic reader 202 on the tool's electronics 164 interprets instructions embedded in the tags T to perform a required operation.

Logic of the controller 180 can count triggers, such as the passage of a particular RFID tag T, a number of RFID tags T, or the like. In addition and as an alternative, the logic of the controller 180 can use timers to actuate the actuators 190 after a period of time has passed since a detected trigger (e.g., after passage of an RFID tag T or after a previous operation is completed). These and other logical controls can be used by the controller 180.

When a particular instruction is detected, for example, the controller 180 operates a switch 182 or the like, to supply power from a power source 184 to one or more of the actuators 190, which can include one or more motors, pumps, solenoids, fuses, or other devices to provide force, pressure, counter bias, or the like to the indexer's insert 130 of the sleeve (100). The power source 184 can be a battery that is deployed downhole with the electronics 164. The actuators 190 in the form of motors can be operatively coupled to the indexer's insert 130 of the sleeve 100 with gears and the like. When activated, the motor actuators 190 can move the indexer's insert 130 as disclosed herein.

The actuators 190 in the form of pump(s) or solenoid(s) can be operatively coupled between pressure source(s) or reservoir(s) as the power source 184 and the indexer's insert 130. For example, the pressure source or reservoir 184 can be a reservoir of high pressure fluid. The solenoid actuators 190 can be activated by the power to open and allow the high pressure fluid to act on the indexer's insert 130. Alternatively, the pressure source(s) or reservoir(s) 184 may be a reservoir of hydraulic fluid. The pump actuators 190 can be activated by the power to pump the hydraulic fluid of the source 184 to apply pressure against the indexer's insert 130. Additionally, the pump actuators 190 can be operated in the reverse to relieve pressure against the insert 130.

Although the disclosed tool has been described as a sliding sleeve, such as a fracturing sleeve for a tubing string, the teachings of the present disclosure can be used for other downhole tools, such as flow valves, sliding sleeves, safety valves, and the like.

Figure 14:
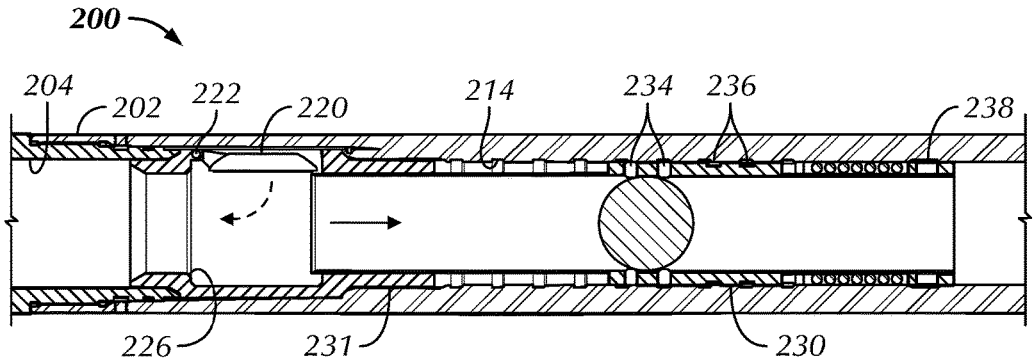
FIG. 14 illustrates an alternative downhole tool having an indexer as disclosed herein.

As one example, FIG. 14 shows portion of a downhole tool as a tubing valve. The tubing valve 200 has a housing 202 defining a housing bore 204 therethrough. Ends (not shown) of the housing 202 couple to a tubing string (not shown) in a conventional manner.

Inside the housing 202, a flapper valve 220 is movable from an opened condition unobstructing the housing bore 202 to a closed condition obstructing the bore 202. An indexer 230 is disposed in the housing's bore 202. The indexer 230 counts passage of plugs or other object through the bore 202 and permits movement of the flapper valve 220 from the opened condition to the closed condition in response to the counted number.

As shown, the indexer 230 includes an insert or flow tube 231 defining a bore 232. This insert 231 is disposed in the bore 204 of the housing 202 and can move axially in the bore 204 from a first condition against the flapper valve 220 in the opened condition to a second condition away from the flapper valve 220. The insert 230 in the second condition permits movement of the flapper valve 220 from the opened condition to the closed condition.

In fact, the insert 231 is a sleeve having a flow tube at its upper end that covers the flapper valve 220 pivotably connected by a hinge 222 to a cage 224 inside the bore 204. When the insert 231 is moved axially downward inside the bore 204, the flow tube at the upper end of the insert 231 exposes the flapper valve 220 to the bore 204, allowing the flapper valve 220 to pivot across the bore 204 and obstruct flow. The hinge 222 can include a spring or the like to bias the flapper valve 220 to its closed condition.

In operation of the tubing valve 200, the indexer's insert 231 indexes as it translates through the housing's bore 204. Initially, the flapper valve 220 is inaccessible to the flow until the arranged index of the indexer's insert 231 has moved out of the way for the flapper valve 220 to close.

The indexer 230 counts passage of plugs through the bore 202 and permits pivoting of the flapper valve 220 in response to the counted number. To do this, the indexer 230 has dogs 234 disposed in the bore 232 of the second insert 231. The dogs 234 are alternatingly engageable and disengagable with the passage of plugs B in the bore 232 and are correspondingly disengageable and engageable with slots 214 defined in the housing bore 204. (Any of the other indexers—either electronic or mechanical—disclosed above could be used instead.) Once the flapper valve 220 is exposed in the bore 204, the flapper valve 220 in the current arrangement pivots upward to prevent downhole pressure from passing further uphole. The opposite configuration is also possible as disclosed herein.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

Although the flapper valve 120 is shown pivotably mounted on a cage 124 that connects to the main insert 110, this may be done to facilitate assembly. An integrated construction between the flapper valve 120 and main insert 110 could be used.

Although the second insert 131 of the indexer 130 has a flow tube at its distal end to move away from the flapper valve 120 and allow it to open, other configurations are possible. Rather than a flow tube, for example, the indexer 130 can use any suitable latch, linkage, arm, etc. between the indexer 130 and the flapper valve 120 to achieve the same results in substantially the same way.

Although reference to balls have been made repeatedly herein as a form of plug to be deployed downhole, other types of plugs, balls, darts, and other objects can be used, as will be appreciated by one skilled in the art.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool responsive to passage of one or more objects and applied fluid pressure, the tool comprising:

a housing defining a housing bore therethrough and defining at least one port communicating the housing bore outside the housing;

a first insert disposed in the housing bore and defining a first bore therethrough from an uphole end to a downhole end, the first insert movable downhole in the housing bore from a closed condition to an opened condition relative to the at least one port, the first insert in the opened condition communicating the housing bore outside the housing through the at least one port;

a flapper valve pivotably connected to the first insert toward the uphole end and being pivotable from an unobstructed condition unobstructing the housing bore to an obstructed condition obstructing the housing bore to the applied fluid pressure; and an indexer disposed toward the downhole end of the first insert, the indexer in a first condition holding the flapper valve in the unobstructed condition, the indexer counting the passage of a number of the one or more objects through the housing bore, the indexer moving to a second condition and pivoting the flapper valve from the unobstructed condition to the obstructed condition in response to the counted number, the flapper valve in the obstructed condition moving the first insert downhole from the closed condition to the opened condition in response to the fluid pressure applied against the flapper valve.

2. The tool of claim 1, wherein the indexer comprises a second insert disposed in the first bore of the first insert and axially movable in the first bore from a first condition toward the flapper valve in the unobstructed condition to a second condition away from the flapper valve, the second insert in the second condition permitting the pivot of the flapper valve from the unobstructed condition to the obstructed condition.

3. The tool of claim 2, wherein the indexer comprises at least one key disposed in a second bore of the second insert, the at least one key alternatingly engageable and disengagable with the passage of each object in the second bore and correspondingly disengageable and engageable with at least one slot in the first bore of the first insert.

4. The tool of claim 3, wherein the at least one key comprises first and second dogs disposed about the second bore, the first dogs axially displaced from the second dogs.

5. The tool of claim 3, wherein the indexer comprises at least one lock disposed on the second insert and alternatingly locking with the at least one slot in the first bore of the first insert.

6. The tool of claim 5, wherein the at least one lock comprises snap rings disposed about the second insert, at least one of the snap rings having a shoulder along a first edge for engaging in the at least one slot and having a ramp along a second edge for passing out of the at least one slot.

7. The tool of claim 5, wherein the indexer comprises a biasing member biasing the second insert axially in the first bore of the first insert toward the first condition.

8. The tool of claim 3, wherein the second insert comprises a pin, and wherein the first bore of the first insert defines a J-slot in which the pin is disposed, the J-slot defining a plurality of junctions for counting the passage of the one or more objects.

9. The tool of claim 8, wherein the first bore of the first insert defines a first retraction slot permitting retraction of the at least one key after first movement of the second insert in the first bore, and wherein the first bore of the first insert defines a second retraction slot permitting retraction of the at least one key after second movement of the second insert in the first bore, the second movement being after the first movement and being longer in extent than the first movement.

10. The tool of claim 9, wherein the second insert moved in the second movement places the second insert in the second condition.

11. The tool of claim 3, wherein the second insert comprises one or more collets having a plurality of fingers with the at least one key.

12. The tool of claim 2, wherein the second insert comprises a lock disposed on the second insert and engageable against the first insert when the second insert is in the second condition.

13. The tool of claim 2, wherein the indexer comprises an electronic sensor sensing the passage of the one or more objects past the electronic sensor.

14. The tool of claim 13, wherein the indexer comprises an actuator in operable communication with the electronic sensor, the actuator disposed relative to the second insert and axially moving the second insert toward the second condition.

15. The tool of claim 14, wherein the actuator is selected from the group consisting of a solenoid, a fuse, a heating coil, a cord, a spring, a motor, and a pump.

16. The tool of claim 1, further comprising a lock disposed on the first insert and engageable in the housing bore with the first insert in the closed condition.

17. The tool of claim 16, wherein the lock comprises a snap ring engaging in a groove defined around the housing bore.

18. The tool of claim 1, wherein the indexer comprises an electronic sensor sensing the passage of the one or more objects for counting.

19. The tool of claim 1, wherein the indexer comprises an actuator actuating the permission of the pivot of the flapper valve.

20. A method of actuating a sliding sleeve downhole on a tubing string, the method comprising:

counting passage of one or more objects that pass through a bore of the sliding sleeve and interact with an indexer disposed toward a downhole end of a first insert disposed in the bore of the sliding sleeve;

closing a flapper valve pivotably connected toward an uphole end of the first insert in response to the counted passage by pivoting the flapper valve from an unobstructed condition unobstructing the bore to an obstructed condition obstructing the bore; and moving the first insert downhole in the bore of the sliding sleeve relative to at least one port in the sliding sleeve by applying fluid pressure down the tubing string against the closed flapper valve.

21. The method of claim 20, wherein counting the passage of the one or more objects through the bore comprises indexing a second insert axially in the sliding sleeve with each passage.

22. The method of claim 21, wherein indexing the second insert axially in the sliding sleeve with each passage comprises alternatingly engaging and disengaging each passage and shifting the second insert axially in response thereto.

23. The method of claim 22, further comprising preventing reverse axial movement on the second insert.

24. The method of claim 21, wherein closing the flapper valve pivotably connected toward the uphole end of the first insert in response to the counted passage comprises pivoting shifting the indexed second insert away from the flapper valve.

25. The method of claim 20, wherein moving the first insert downhole relative to the at least one port with the pressure applied against the closed flapper valve comprises opening the at least one port in the sliding sleeve with the applied pressure against the closed flapper valve by moving the first insert associated with the closed flapper valve in the sliding sleeve open relative to the at least one port.

26. The method of claim 20, wherein counting the passage of the one or more objects that pass through the bore comprises releasing each of the one or more objects.

27. The method of claim 20, further comprising milling out at least the flapper valve from the bore of the sliding sleeve.

28. A method of actuating a sliding sleeve downhole on a tubing string with passage of one or more objects through a bore of the sliding sleeve and applied fluid pressure in the bore, the method comprising:

sensing a trigger in response to the passage of the one or more objects through the bore of the sliding sleeve;

closing a flapper valve pivotably connected toward an uphole end of an insert of a plugless valve disposed in the bore of the sliding sleeve in response to the sensed trigger by pivoting the flapper valve from an unobstructed condition unobstructing the bore to an obstructed condition obstructing the bore; and opening a port in the sliding sleeve by applying fluid pressure down the tubing string against the closed flapper valve and moving the first insert downhole in the bore of the sliding sleeve relative to the port in the sliding sleeve.

* * * * *